United States Patent [19]

Budrose

[11] 4,028,971

[45] June 14, 1977

[54] PLIERS

[75] Inventor: Charles R. Budrose, Melrose, Mass.

[73] Assignee: Upaya, Inc., Saugus, Mass.

[22] Filed: June 21, 1976

[21] Appl. No.: 698,412

[52] U.S. Cl. ..... 81/383.5; 30/246; 30/191

[51] Int. Cl.[2] ..... B25B 7/12

[58] Field of Search ..... 81/300, 345, 346, 376, 81/377, 378, 379, 380, 383.5; 30/191, 192, 228, 246

[56] References Cited

UNITED STATES PATENTS 852,479 5/1907 Weiss ..... 30/191

FOREIGN PATENTS OR APPLICATIONS 448,072 8/1927 Germany ..... 30/246

*Primary Examiner*—James L. Jones, Jr.
*Attorney, Agent, or Firm*—Wolf, Greenfield & Sacks

[57] ABSTRACT

A pair of pliers comprising a jaw assembly that is rotatable relative to a handle assembly preferably through a full 360° angle thereby permitting use of the pliers with the jaw assembly in a plane that is independent of the plane of the handle assembly. The jaw assembly comprises a pair of pivotally interconnected jaws each having operating ends and a jaw centering mechanism. The handle assembly comprises a pair of handles fixed to a conic member and a linkage mechanism including a collar. The jaw assembly and the handle assembly are intercoupled by an operating shaft that passes in sequence through the collar and an aperture in the conic member to the jaw assembly whereby upon closing the handles the collar moves the shaft longitudinally thereby passing the operating ends into the conic member causing the jaw assembly to close. The conic member and other components interacting therewith permit relative rotation between the handle assembly and jaw assembly whether the pliers are open, closed or partially closed.

17 Claims, 3 Drawing Figures

PLIERS

BACKGROUND OF THE INVENTION

The present invention relates to the field of hand pliers. Conventional pliers are constructed so that each jaw of the pliers is actually an extension of a corresponding handle and thus the jaws and handles swing in the same plate. Thus, the position of the jaws constrain the hand movement to the same plane as the plane of the jaws. Although the person's hand, wrist and arm in combination can function as a partial universal joint, the person using a conventional pair of pliers is limited in the degree of rotation of the hand. Thus, it is quite often found in practice that it is necessary to provide jaw movement in a plane which is uncomfortable or inconvenient for the hand to move in. Also, this is often the case wherein an object is grasped by a pair of pliers in a convenient manner and then a change in position is desired to a less convenient position. For example, in the wiring of circuit boards, a wire may be grasped in a comfortable position, but then may have to be aligned in a specific orientation on the board which may be uncomfortable and inefficient for the hand to achieve.

Accordingly, one object of the present invention is to overcome the aforementioned difficulties by providing a pliers having a jaw mechanism whose plane is independent of the plane of the handle mechanism. In accordance with the present invention this is achieved by having the jaws of the pliers rotatable through an angle of 360° yet still making the jaws manipulatable by the handle of the device.

Another object of the present invention is to provide an improved form of hand pliers which is relatively simple in construction and which can be operated quite easily.

Still a further object of the present invention is to provide hand pliers in accordance with this invention and which permit positioning or rotation of materials even after being grasped by the device.

SUMMARY OF THE INVENTION

To accomplish the foregoing and other objects of this invention there is provided a hand pliers that comprises a jaw assembly that is rotatable relative to a handle assembly preferably through an angle of 360°. The jaw assembly includes a pair of jaws and means pivotally securing the jaws with each jaw having a gripping end and an operating end. The jaw assembly also comprises a jaw centering mechanism. The handle assembly comprises a pair of handles, concave or conic means having an aperture therethrough, means connecting the handles to the outer surface of the concave or conic means and a pair of links pivotally connected to the respective handles. The jaw assembly and the handle assembly are intercoupled by an operating shaft that passes in sequence through a common collar for the pair of links and the aperture in the conic or concave member. The operating shaft connects to the jaws of the jaw assembly so that upon the closing of the handles the collar moves the shaft longitudinally thereby passing the operating ends into the conic or concave member causing the jaw assembly to close. The conic or concave member in association with the operating ends of the jaws permits relative rotation between the handle assembly and the jaw assembly whether the pliers are open, closed, or partially closed.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
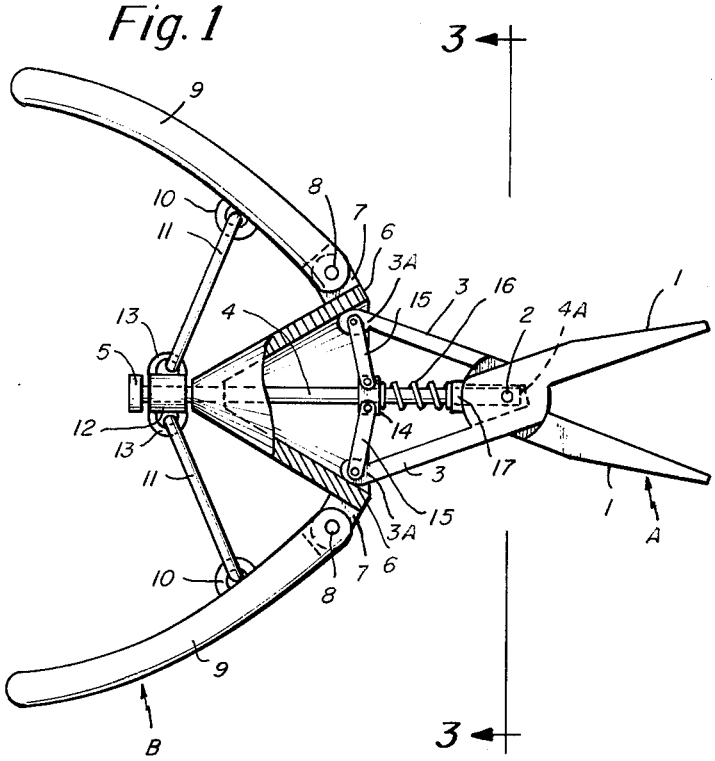
FIG. 1 is an elevational view of the pliers in an open position.

Referring now to the drawings there is shown a jaw assembly A and a handle assembly B which are operatively intercoupled by operating shaft 4. The jaw assembly A comprises a pair of jaws 1 which are pivotally interconnected by a hinge pin 2. The jaws terminate respectively in arms 3 which have rounded and polished ends 3A. The operating shaft 4 is secured at its end 4A to the mid-point of the hinge pin 2. The shaft 4 has limited swivelling movement around the hinge pin 2 preferably provided by arcuate slots in the jaws 1 permitting passage of the end 4A of the shaft to the hinge pin 2. The opposite end of the operating shaft 4 terminates in a flanged collar 5.

The handle assembly B comprises cone member 6, handles 9, and actuating links 11. The cone member 6 preferably has a polished interior surface against which the polished ends 3A of the arms 3 rest and move. Operating shaft 4 passes through an aperture in the apex of the cone member 6 and the shaft 4 is dimensioned relative to the aperture in the cone to provide easy sliding movemennt of the shaft 4 relative to the cone member 6. Handle support tabs 7 are affixed to and extend from the exterior forward edge of the cone member 6. One end of each of the handles 9 mount to the respective tabs 7 by means of mounting pins 8. The mounting pins 8 permit rotational movement through a limited angle between the handles 9 and the cone member 6.

The handles 9 each have facing support loops 10. One end of each of the actuating links 11 is secured in each link support loop 10. The links 11 may have a hooked end for passing through the loop 10. Each of the links 11 is permitted rotational movement relative to the support loops 10. Actuating collar 12 has an aperture which permits easy sliding movement of the cone 12 along the operating shaft 4. The collar 12 has affixed thereto two diametrically disposed support tabs or loops 13. The other end of each of the actuating links 11 is rotatably affixed to these support loops or tabs 13. Again, that end of each of the links 11 may have a hooked end for engaging with the loops 13. Similarly, a cotter pin arrangement may be used for securing the links 11 in their end support loops.

The jaw assembly A also comprises a jaw centering mechanism which includes centering disc 14 which has a central aperture therethrough for receiving the shaft 4. The centering disc 14 moves slidingly along operating shaft 4 and is connected by means of links 15 to the ends 3A of the arms 3. The links 15 may be connected in any well known manner such as by using pivot pins at opposite ends thereof. The disc 14 may be circular or rectangular in shape. With the use of pivot pins at opposite ends of the links 15 they can rotate at their mounting points in both the centering disc 14 and the arm ends 3A. The compression spring 6 urges the centering disc 14 and the spring support collar 17 apart. The spring support collar 17 moves relative to the shaft 4 and rides against the back edge of the jaws 1.

Figure 2:
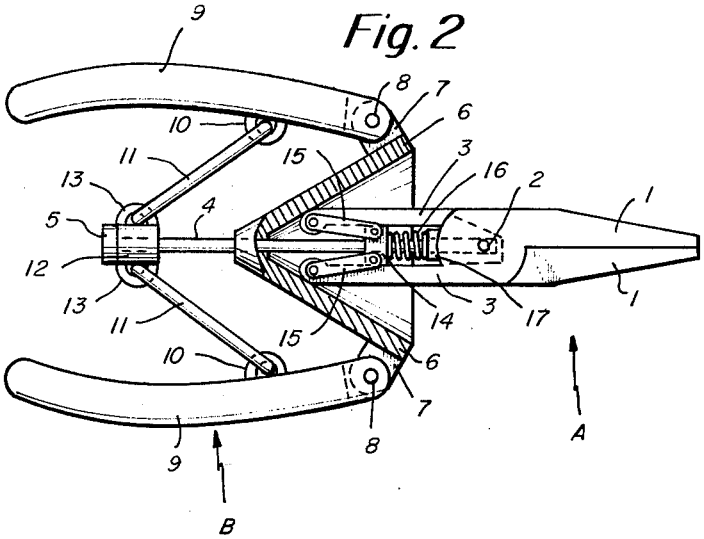
FIG. 2 is an elevational view of the pliers in a closed position.
Figure 3:
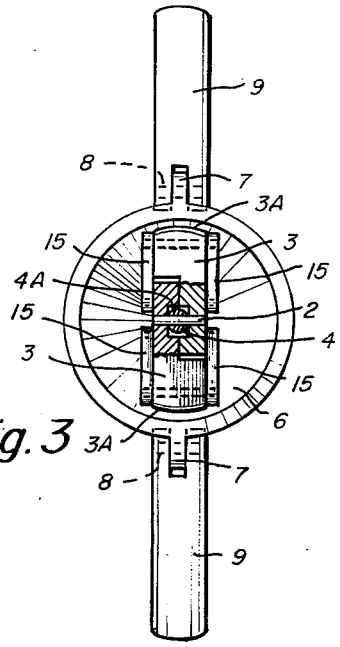
FIG. 3 is a cross-sectional view taken along line 3–3 of FIG. 1.

FIG. 1 shows the pliers in their open position. The spring 16 is in its expanded position thereby urging the centering disc 14 away from the spring support collar 17 and in turn away from the jaw assembly A. The pressure on the centering disc 14 is also transmitted through the links 15 to the arms 3, pushing them outwardly and thus opening the jaws of the device. Simultaneously, the operating shaft 4 is moved through the cone member 6, for example, from a position like that shown in FIG. 2 to a position of FIG. 1 wherein the grip on the handles has been released. As this occurs the flanged collar 5 applies a pressure to the collar 12 which in turn transmits a force through the links 11 to the handles 9. As the angle between the two links 11 increases the handles 9 are open or spread to a position as shown in FIG. 1 with the spring 16 totally expanded. The centering disc 14 and its associated links 15 during this opening sequence operate to keep the entire jaw assembly centered in the cone member 6 thereby preventing any tipping of the jaws.

When the pliers are to be operated to their closed position the operator applies a squeezing pressure to the handles 9 which causes the links 11 to be urged angularly towards each other. This movement is transmitted to the collar 12 forcing this collar in a direction away from the jaws and finally to the position shown in FIG. 2. The actuating collar 12 pushes against the flange 5 and pulls the operaing shaft 4 through the cone member 6 thereby drawing the jaw assembly A into the cone member 6. As this occurs, the jaw arms 3 are forced toward each other by the inclined inner surface of the cone member 6, causng the jaws 1 to close. The centering disc 14 moves toward the support collar 17 by means of the pressure transmitted through the centering links 15 thereby causing the spring 16 to compress to the final position shown in FIG. 2.

The device shown in the drawings may, of course, also assume any other intermediate position between a completely open position or a completely closed position. Also, in any position of the device the jaw assembly A can be rotated within the cone member 6. When the jaw assembly A is rotated relative to the cone member 6, the operating shaft 4 rotates with the jaw assembly.

Having described one embodiment of the present invention, it should now be apparent to those skilled in the art that there are numerous modifications that can be made in this embodiment and all such modifications are contemplated as falling within the scope of this invention, as defined by the appended claims.

What is claimed is:

1. A plier comprising;

a jaw assembly including a pair of jaws and means pivotally securing the jaws with each jaw having a gripping end and an operating end, a handle assembly including a pair of handles, concave means, means connecting the handles to the concave means, and linkage means, and a shaft means coupled through an aperture in the concave means having one end coupled to the jaw assembly and means for operatively coupling the other end of the shaft means to the linkage means, said linkage means also coupled to and operative by squeezing the handles to move the shaft means and in turn carry the jaw assembly into the concave means with the operating ends of the jaws being closed upon movement into the concave means thereby causing the gripping ends to close.

2. A plier as set forth in claim 1 wherein said jaw assembly comprises a jaw centering mechanism and biasing means for normally urging the pliers to an open position.

3. A plier as set forth in claim 2 wherein said jaw centering mechanism comprises a collar disposed about the shaft means and a pair of links pivotally coupled between sides of the collar and the operating ends of the jaws, respectively.

4. A plier as set forth in claim 3 wherein said biasing means comprises a compressable spring having one end contacting the collar and another end contacting a stop means.

5. A plier as set forth in claim 1 wherein said jaw assembly comprises means for urging the jaws apart.

6. A plier as set forth in claim 1 wherein said concave means comprises a conic member having the aperture at the apex.

7. A plier as set forth in claim 6 wherein the operating ends of the jaws terminate in a smooth rounded surface contacting an interior smooth surface of the conic member.

8. A plier as set forth in claim 1 wherein said means connecting the handles to the concave means comprise a pair of diametrically disposed tabs for pivotally supporting the handles on opposite sides of and from the concave means.

9. A plier as set forth in claim 1 wherein said shaft means other end is enlarged and is contacted by the linkage means for moving the shaft means longitudinally.

10. A plier as set forth in claim 9 wherein said linkage means includes collar means disposed about the shaft means adjacent the enlarged end.

11. A plier as set forth in claim 1 wherein said linkage means comprises a collar means disposed about the shaft means adjacent the other end of the shaft means, a pair of links, means pivotally connecting one end of each link to a corresponding handle, and means for pivotally connecting the other end of each link to the collar means.

12. A plier as set forth in claim 1 wherein the one end of the shaft means couples to the means pivotally securing the jaws.

13. A plier comprising;

a pair of jaws each having a gripping end and an operating end, means securing the jaws together for relative pivotal movement, a pair of handles, a shaft means having one end coupled operatively with the jaws, concave means having an aperture for receiving the shaft means, said shaft means being slideable relative to the concave means, means pivotally connecting one end of each handle to opposite outer surfaces of the concave means, and linkage means including a pair of foldable links coupled to the handles respectively, and for operating the shaft means to move the shaft means longitudinally as the handles are squeezed to thereby carry the jaws operating ends into the concave means and open the jaws.

14. A plier as set forth in claim 13 comprising a jaw centering mechanism intercoupled between the jaws operating ends and the shaft means to assure that both jaws move evenly.

15. A plier as set forth in claim 13 comprising means for urging the jaws apart including biasing means associated with the jaws.

16. A plier as set forth in claim 13 wherein said concave means comprises a conic member having an aperture at the apex.

17. A plier as set forth in claim 13 wherein said shaft means other end is flanged and is contacted by the linkage means for moving the shaft means longitudinally.

* * * * *